US011149526B2

(12) United States Patent
Brodsky et al.

(10) Patent No.: US 11,149,526 B2
(45) **Date of Patent: *Oct. 19, 2021**

(54) DETERMINATION OF THE OPTIMAL FLUID PULSES FOR ENHANCEMENT OF RESERVOIR PERMEABILITY AND PRODUCTIVITY

(71) Applicant: The Regents of the University of California, Oakland, CA (US)

(72) Inventors: Emily E. Brodsky, Santa Cruz, CA (US); Thibault Candela, Union City, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/688,470

(22) Filed: Nov. 19, 2019

(65) Prior Publication Data

US 2020/0318459 A1 Oct. 8, 2020

Related U.S. Application Data

(63) Continuation of application No. 15/577,617, filed as application No. PCT/US2016/038335 on Jun. 20, 2016, now Pat. No. 10,513,909.

(Continued)

(51) Int. Cl.

| | |
|---|---|
| ***E21B 37/00*** | (2006.01) |
| ***E21B 47/06*** | (2012.01) |
| ***E21B 49/00*** | (2006.01) |
| ***E21B 47/10*** | (2012.01) |
| ***E21B 43/00*** | (2006.01) |

(52) U.S. Cl.

CPC ..... *E21B 37/00* (2013.01); *E21B 43/003* (2013.01); *E21B 47/06* (2013.01); *E21B 47/10* (2013.01); *E21B 49/008* (2013.01)

(58) Field of Classification Search

CPC ..... E21B 43/003; E21B 49/008; E21B 37/00; E21B 47/06; E21B 47/10

See application file for complete search history.

(56) References Cited

U.S. PATENT DOCUMENTS 5,503,001 A * 4/1996 Wong ..... G01N 33/241 324/351

2001/0017206 A1* 8/2001 Davidson ..... E21B 28/00 166/249

(Continued)

*Primary Examiner* — Caroline N Butcher

(74) *Attorney, Agent, or Firm* — Lumen Patent Firm

(57) ABSTRACT

A method of oscillating a pressure in a borehole is provided that includes determining a hydraulic diffusivity, using injection tests, in a borehole, calculating a pressure field using a programmed computer at a proximal distance to the borehole using a first forced oscillation result in a porous media, calculating a flow rate at the proximal distance from the borehole by multiplying a gradient of the pressure field by a measured permeability and dividing by a viscosity of a fluid, computing, using the programmed computer, a volumetrically averaged flow rate by integrating a square of the flow rate over a volume around the borehole, outputting a value of an angular frequency for which the volumetrically-averaged flow rate is maximum, and operating a pump at a second forced oscillation according to the angular frequency on the fluid.

4 Claims, 1 Drawing Sheet

Related U.S. Application Data

(60) Provisional application No. 62/189,092, filed on Jul. 6, 2015.

(56) References Cited

U.S. PATENT DOCUMENTS

| | | | | |
|---|---|---|---|---|
| 2002/0134587 | A1* | 9/2002 | Rester | E21B 47/107 175/48 |
| 2005/0171699 | A1* | 8/2005 | Zazovsky | E21B 49/008 702/11 |
| 2008/0066534 | A1* | 3/2008 | Reid | E21B 49/06 73/152.11 |
| 2011/0315374 | A1* | 12/2011 | Rybakov | E21B 43/16 166/248 |
| 2012/0160494 | A1* | 6/2012 | Nikipelo | E21B 43/24 166/303 |

* cited by examiner

DETERMINATION OF THE OPTIMAL FLUID PULSES FOR ENHANCEMENT OF RESERVOIR PERMEABILITY AND PRODUCTIVITY

CROSS-REFERENCE TO RELATED APPLICATIONS

This application is a continuation of U.S. patent application Ser. No. 15/577,617 filed Nov. 28, 2017, which is incorporated herein by reference. U.S. patent application Ser. No. 15/577,617 application is a 371 of PCT application PCT/US2016/038335 filed Jun. 20, 2016. PCT/US2016/038335 filed Jun. 20, 2016 claims the benefit of U.S. Provisional application 62/189,092 filed Jul. 6, 2015.

FIELD OF THE INVENTION

The invention generally relates to underground well permeability. More specifically, the invention relates to a method of optimizing volumetric change in a flow rate around a wellbore to increase permeability.

BACKGROUND OF THE INVENTION

It is often desirable to increase the permeability near an underground well, and it is known to apply mechanical forcing to attempt to increase permeability. However, such forcing has many parameters, and it is not a priori clear, or clear from prior work in this field, which parameters are result-effective. Accordingly, there is a need to identify and implement such result-effective parameters to improve permeability in underground wells.

SUMMARY OF THE INVENTION

To address the needs in the art, method of oscillating a pressure in a borehole is provided that includes determining a hydraulic diffusivity, using injection tests, in a borehole, calculating a pressure field, using an appropriately programmed computer, at a proximal distance to the borehole using a first forced oscillation result in a porous media, calculating a flow rate, using the appropriately programmed computer, at the proximal distance from the borehole by multiplying a gradient of the pressure field by a measured permeability and dividing by a viscosity of a fluid under test, computing, using the appropriately programmed computer, a volumetrically averaged flow rate by integrating a square of the flow rate over a volume around the borehole, outputting a value of an angular frequency for which the volumetrically-averaged flow rate is maximum, and operating a pump at a second forced oscillation according to the angular frequency on the fluid under test, where an increase in permeability around the borehole is provided.

According to one aspect of the invention, the pressure field in a porous media is calculated according to $$p(r) = \varepsilon\left[1 + \frac{C_2}{(1 - C_2 K_0(s_w))} K_0(s)\right],$$

where p(r) is the pressure at a distance r from the borehole, ε is an imposed oscillation amplitude, $K_0$ is a modified Bessel function of the second kind of order 0, s is a parameter based on frequency such that $$s = \sqrt{\frac{i\omega}{\kappa}}\, r,$$

κ is the hydraulic diffusivity, i is the square root of −1, ω is the angular frequency in radians, and $s_w$ is the value of s at a radius of the borehole, where $C_2$ is a constant having a relation $$C_2 = \frac{-r_w i\omega}{2TK_1(s_w)}\sqrt{\frac{\kappa}{i\omega}}$$

where T is a hydraulic transmissivity, $K_1$ is a modified Bessel function of order 1 and $r_w$ is the radius of the borehole.

In another aspect of the invention, a frequency that maximizes the flow rate at a distance that is selected to dislodge a particular blockage.

According to a further aspect of the invention, the borehole includes a well or a fracture.

DETAILED DESCRIPTION

The current invention provides a method for cleaning wellbores and enhancing permeability near a well or hydraulic fracture. The invention includes an algorithm that solves for the optimal frequency of pulses to clear pores and fractures near the well or hydraulic fracture. The algorithm combines the empirical understanding of permeability enhancement developed during laboratory experiments with an analytical calculation of flow in the immediate vicinity of a well. The combination results in a novel method that can be utilized in geothermal, oilfield and environmental applications.

Specifically for a given set of reservoir properties (hydraulic diffusivity) the solution determines the best frequency of forcing to be applied down hole in order to optimize the volumetric change in flow rate around the well and therefore the permeability.

Figure 1:
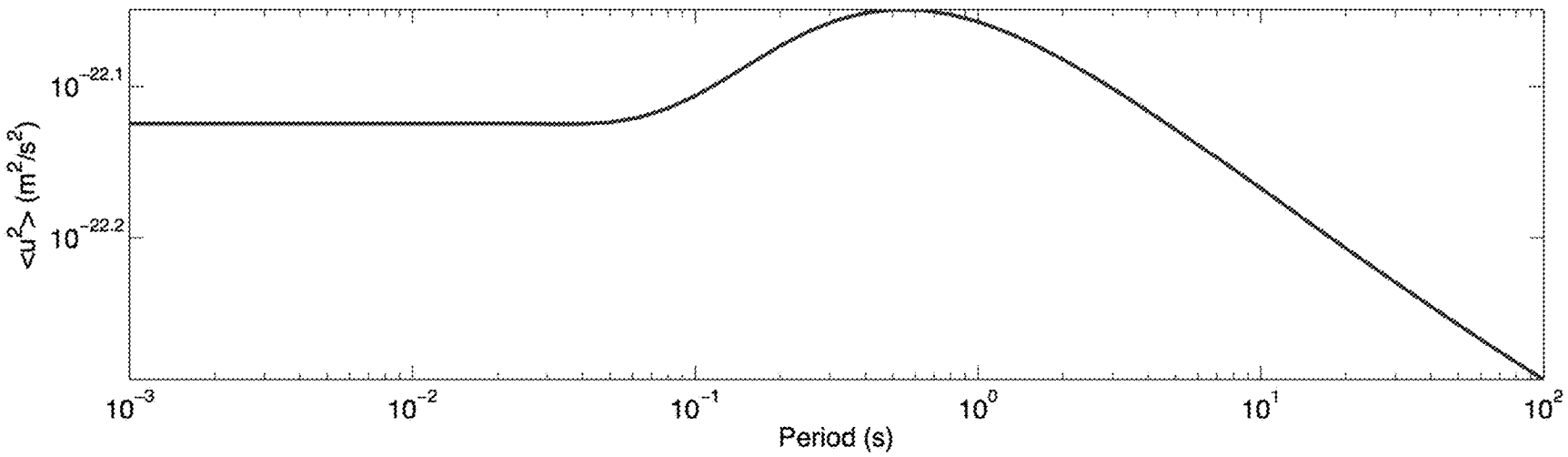
FIG. 1 shows an example of the results for typical well parameters, where the algorithm predicts that the optimal period is ~0.5 s (2 Hz), according to one embodiment of the invention.

According to one embodiment, an algorithm is provided that allows fluid pulses to be used to increase the permeability near a well by clearing the pores and fractures, including hydraulic fractures. Increasing the permeability can be desirable for geothermal power production, resource extraction, injection treatments and environmental remediation. In all of these situations, the pores, wells and fractures wells commonly clog due to scaling, particulates, crushed proppants, completion fluids and gels, and gas or oil droplets. Here, a method of designing fluid oscillations is provided that will increase the effective permeability. In the case of injection treatments, the same method designs fluid oscillations that could facilitate spreading of the treatment fluids through the reservoir. Flow equations for the flow around a well in a porous media are solved to determine the frequency that maximizes the average flow over the volume around the well. Prior laboratory experiments demonstrated that average flow over the volume is the determining factor for permeability enhancement. An example of the results for typical well parameters is shown in FIG. 1. For this case, the algorithm predicts that the optimal period is ~0.5 s (2 Hz).

Figure 2:
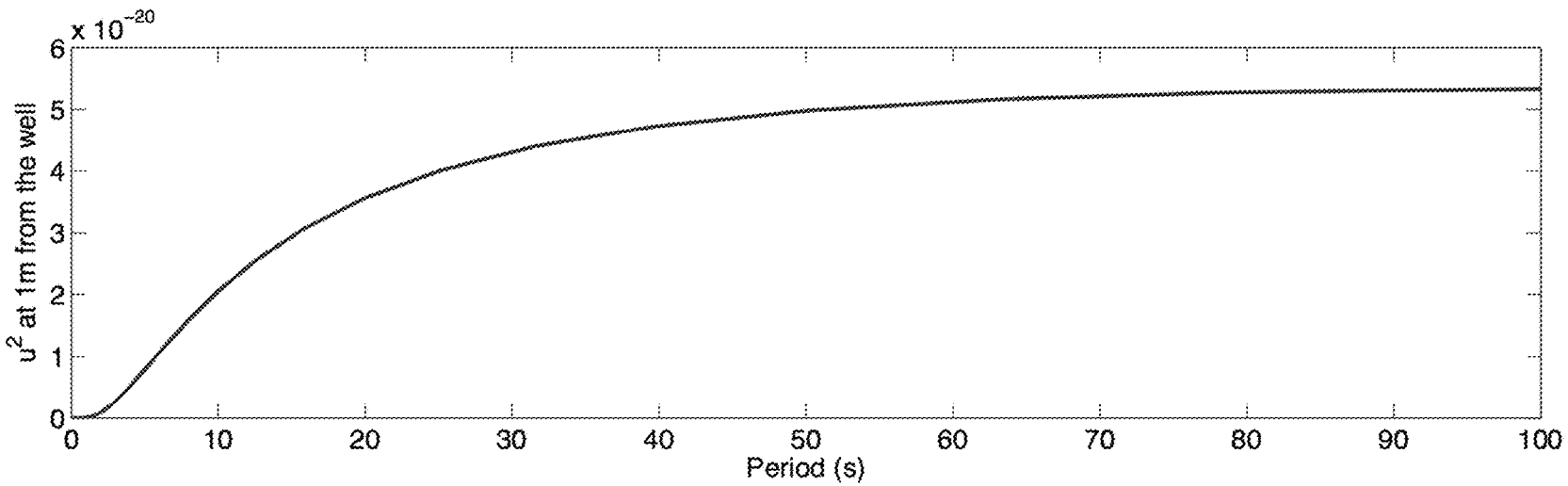
FIG. 2 shows the algorithm predicts that longer period oscillations are optimal for fracture clearing, according to one embodiment of the invention.

In another embodiment of the invention, the algorithm is the determination of the period of forcing that maximizes the flow rate at a given distance from the well. This solution can help to optimize the stimulation of one particular location of the reservoir as a fracture corridor for example. The productivity of a hydraulically fractured reservoir is often less than predicted from design considerations. In this context, and giving the extensive cost of the hydro-fracturing stage, the current invention can help to clean up one individual fracture. For the example in FIG. 2, the algorithm predicts that longer period oscillations are optimal for fracture clearing. The distinction between the results in FIG. 1 and FIG. 2 demonstrates a range of results that could result from properly designed fluid oscillations.

The method according to the current invention relies on mechanical forcing and affects a restricted volume. It does not require any chemical additives with potentially negative environmental consequences. It is a safe alternative that can increase permeability while reducing the magnitude of the injection rate and reduce the risks of induced seismicity. In order to apply the solution, the hydraulic diffusivity of the reservoir of interest is needed. This parameter can be easily deduced from injection tests routinely performed in most of the operated wells.

An exemplary embodiment of the invention includes the following steps:

1) From an appropriately programmed computer, calculating the pressure field in the vicinity of the borehole or fracture using a semi-analytical solution for forced oscillations in porous media. For instance, for oscillating pressure in a borehole the pressure field solution is $$p(r) = \varepsilon\left[1 + \frac{C_2}{(1 - C_2 K_0(s_w))} K_0(s)\right]$$

where p(r) is the pressure at a distance r from the well, ε is the imposed oscillation amplitude, $K_0$ is a modified Bessel function of the second kind of order 0, s is a parameter based on frequency such that $$s = \sqrt{\frac{i\omega}{\kappa}}\, r,$$

κ is the hydraulic diffusivity, i is the square root of −1, ω is the angular frequency in radians, and $s_w$ is the value of s at the wellbore radius. The constant $C_2$ is $$C_2 = \frac{-r_w i\omega}{2TK_1(s_w)}\sqrt{\frac{\kappa}{i\omega}}$$

where T is the hydraulic transmissivity, $K_1$ is the modified Bessel function of order 1 and $r_w$ is the radius of the well.

2) Calculating the flow rate at all distances from the well or fracture by multiplying the gradient of the pressure field by the permeability and dividing by the viscosity of the fluid.

3) Computing the volumetrically averaged flow rate by integrating the square of the flow over a volume around the well or fracture.

4a) Select the value of the angular frequency ω for which the volumetrically-averaged flow rate in step 3 is maximum.

4b) Alternatively select the frequency that maximizes the flow rate at a particular distance in step 2, where alternative implementation is useful for situations where the goal is to dislodge a particular blockage.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For example, a series of pulses of coordinated frequencies can be applied rather than just the single, optimal monochromatic pulse.

All such variations are considered to be within the scope and spirit of the present invention as defined by the following claims and their legal equivalents.

What is claimed:

1. A method of oscillating a pressure in a borehole, comprising:

a) determining a hydraulic diffusivity, using injection tests, in a borehole;

b) calculating a pressure field, using a programmed computer, at a proximal distance to said borehole using a first forced oscillation in a porous media;

c) calculating a flow rate of a fluid, using said programmed computer, at said proximal distance from said borehole by multiplying a gradient of said pressure field by a measured permeability and dividing by a viscosity of said fluid;

d) computing, using said programmed computer, a volumetrically averaged flow rate by integrating a square of said flow rate over a volume around said borehole;

e) outputting a value of an angular frequency for which said volumetrically-averaged flow rate is maximum; and f) operating a pump at a second forced oscillation according to said angular frequency on said fluid, wherein an increase in permeability around said borehole is provided.

2. The method according to claim 1, wherein said pressure field in a porous media is calculated according to $$p(r) = \varepsilon\left[1 + \frac{C_2}{(1 - C_2 K_0(s_w))} K_0(s)\right],$$

wherein p(r) is the pressure at a distance r from said borehole, E is an imposed oscillation amplitude, $K_0$ is a modified Bessel function of the second kind of order 0, s is a parameter based on frequency such that $$s = \sqrt{\frac{i\omega}{\kappa}}\, r,$$

κ is the hydraulic diffusivity, i is the square root of −1, ω is the angular frequency in radians, and $s_w$ is the value of s at a radius of said borehole, wherein $C_2$ is a constant having a relation $$C_2 = \frac{-r_w i\omega}{2TK_1(s_w)}\sqrt{\frac{\kappa}{i\omega}}$$

where T is a hydraulic transmissivity, $K_1$ is a modified Bessel function of order 1 and $r_w$ is the radius of said borehole.

3. The method according to claim 1, wherein a frequency that maximizes said flow rate at a distance selected to dislodge a particular blockage.

4. The method according to claim 1, wherein said borehole comprises a well or a fracture.

* * * * *